United States Patent [19]

Maharidge

[11] 4,134,235

[45] Jan. 16, 1979

[54] ONE CHUCK GRINDING APPARATUS FOR END MILLING CUTTERS AND THE LIKE

[76] Inventor: Steve Maharidge, 14410 Ridge Rd., North Royalton, Ohio 44133

[21] Appl. No.: 798,245

[22] Filed: May 18, 1877

[51] Int. Cl.[2] ..... B24B 3/04

[52] U.S. Cl. ..... 51/92 ND; 51/225

[58] Field of Search ..... 51/92 R, 92 ND, 224, 51/225, 231, 218 R, 218 A

[56] References Cited

U.S. PATENT DOCUMENTS

| | | | |
|---|---|---|---|
| 2,332,510 | 10/1943 | Franzen | 51/225 |
| 2,401,874 | 6/1946 | Kilbride | 51/225 X |
| 2,690,037 | 9/1954 | Meyer | 51/225 |
| 3,365,843 | 1/1968 | Robinson | 51/225 |
| 3,624,718 | 11/1971 | Ribich | 51/225 |
| 3,680,263 | 8/1972 | Johnson | 51/225 |
| 3,722,148 | 3/1973 | Grahn | 51/225 |

*Primary Examiner*—Nicholas P. Godici
*Attorney, Agent, or Firm*—Alfred D. Lobo

[57] ABSTRACT

Apparatus for manually sharpening the bottom, radially divergent, flute ends or cutting edges of an end milling cutter (hereinafter referred to as an "end mill") which apparatus includes: a stationary, beveled disc-type or plain grinding wheel mounted for rotation about a horizontal axis (or y-axis), so as to present the face of the wheel to an operator, and a tool-holding fixture having a base member mounted on the worktable of a conventional tool grinder. The worktable of the grinder is capable of movement along three axes, namely a longitudinal axis (or x-axis), a horizontal axis (or y-axis) toward and away from the circular face of the disc, and a vertical axis (or z-axis), by manual manipulation of individual table-adjusting wheels. The fixture includes a workhead mounted on a carriage which in turn is translatably mounted for linear to and fro motion, on a base member with bearing means. The workhead is mounted on the carriage for pivotable movement about a longitudinal axis (x-axis). An end mill holder comprising a bushing or collet is rotatably disposed in the workhead so that the end mill may be rotated about the end mill's longitudinal (vertical) axis. The end mill is held in a vertical plane, and index plate means are preferably provided for indexing each cutting tooth or edge of an end mill along the y-axis before it is sharpened. Once the end mill is locked into the holder, or "chucked," the end mill may be dished and gashed, and primary and secondary clearances of the flute ends may be provided, all without removing the end mill, hence the "one chuck" designation.

3 Claims, 10 Drawing Figures

ONE CHUCK GRINDING APPARATUS FOR END MILLING CUTTERS AND THE LIKE

BACKGROUND OF THE INVENTION

No effort has been spared over the past several decades to develop the numerous modern universal cutter and tool grinding fixtures and machines which provide flexibility of operation and are adaptable to many kinds of work. In general, they are designed to hold a milling cutter in a predetermined fixed position and to apply a grinding wheel accurately to sharpen the cutter's cutting edges uniformly and provide desired clearance for the effective utilization of the cutter. It is well known that uniformity of a tool is correlatable to the lifetime of its use, that this uniformity is not attained in manually sharpened tools, and consequently automatically sharpened tools are purchased, particularly for use with numerically controlled machines, so the tools can be replaced on a regular basis to minimize downtime.

A dull cutter, especially an end mill, slows production and gives shoddy results, so it is desirable to sharpen end mills frequently. Usually this is not easily done. To sharpen an end mill easily, requires expensive machine tools beyond the means of most machine tool shops, especially the small volume ones. Typical of the sophisticated grinders used to sharpen end mills are ones disclosed in U.S. Pat. Nos. 3,719,459; 3,680,262; and 3,813,823, none of which is suitable for the use of a small machine shop operator. Manually operated grinders used to sharpen end mills, which grinders are within the economic and technological means of a small machine shop operator, are disclosed in U.S. Pat. Nos. 2,690,037; 2,958,988; 3,117,399; 3,352,068; and 3,365,843. In no practical manual grinding fixture in the prior art is it possible to observe the edges of the teeth while they are being ground.

Conventional manual grinding of end mills is generally effected in inserting the straight shank of a damaged end mill into a chuck held in a motor-driven workhead, and rotating the end mill against a rotating grinding wheel to cut-off the damaged end, then changing to a small diameter wheel (type No. 1), hollow grinding the end of the end mill, changing to a cup wheel (type No. 11) to grind the cutter clearance on the fluted ends, again changing to a 6" cup wheel (type No. 11) to grind the cutting clearance on the fluted ends, and finally grinding the secondary clearance or relief on the fluted ends. These operations are described in greater detail in available shop manuals such as one published by Covel Manufacturing Company, Benton Harbor, Mich.

Those skilled in the art will appreciate the difficulty of grinding an end mill with precision and uniformity by utilizing conventional manual methods; they also appreciate and rue the inordinate expenditure of time entailed in performing a palpably simple task. They will therefore especially appreciate the convenience and simplicity of being able to utilize a conventional, manually adjustable worktable of a fixed head grinder in conjunction with a fixture which requires only that the end mill be tiltable in a vertical plane, to obtain sharp, correctly angled cutting edges, and, that the nearly vertically held end mill be rotatable about its longitudinal axis.

SUMMARY OF THE INVENTION

I have invented an apparatus which is economical to manufacture and use, and which permits an operator in a low-volume machine shop to sharpen the bottom cutting edges of an end mill efficiently and economically. The apparatus of this invention discloses a tool grinder which comprises a stationary, rotatably disposed, disc-shaped grinding wheel the periphery of which is beveled; a base mounted beneath the grinding wheel on a worktable which is longitudinally (x-axis), horizontally (y-axis), and vertically (z-axis) adjustable; a carriage mounted on the base for linear reciprocation along a horizontally y-axis; a workhead mounted on the carriage for pivotable movement about a longitudinal x-axis in a vertical support member of the carriage; an end mill holder rotatably disposed in the workhead so that the end mill may be held essentially vertically and rotated about its (the end mill's) longitudinal axis; and an index plate means with a serrated circumference subdivided into a multiple of the number of cutting edges to be sharpened.

Accordingly it is a general object of this invention to provide a tool holding fixture for sharpening the radially divergent flute ends of cutting teeth of an end mill with a beveled saucer or dish or disc-shaped grinding wheel (also referred to as a "plain" wheel), without removing the end mill from the fixture and without moving or changing the wheel, at the same time being able to visually observe the sharpening operation at all times. It will be evident that, where no vertical adjustment of the worktable is to be had, the wheel is to be vertically adjustable.

It is a specific object of this invention to provide a fixture for profile sharpening the plural radially divergent cutting teeth (also referred to as "bottom edges") of an end mill, one tooth at a time, with an essentially flat or slightly concave relief, with preselected primary and secondary clearance, by securing the end mill in a generally vertical position and utilizing a fixedly mounted beveled grinding wheel to abrade a rear cutting tooth of an essentially vertically held end mill, so that no "blind" passes are made on the teeth of the tool.

It is also a specific object of this invention to provide a fixture in which an end mill is tilted from the vertical (z-axis), away from the operator for good visibility, and sharpened with a grinding wheel the periphery of which is dressed to a thickness corresponding approximately to the width of the radial gashes separating the cutting edges.

Another general object of this invention is to provide a manual method with the emphasis on speed and simplicity for a semi-skilled operator to sharpen an end mill with uniformity and reproducibility with a rotating, plain grinding wheel, by placing and locking the end mill vertically in the holder of a workhead of a fixture so that the vertical center-lines of the end mill and the wheel are laterally off-set relative to each other, visually aligning a tooth in a predetermined relationship with the periphery of the wheel which is dressed to present a grinding profile having the same width as that of the radial gashes to be made between teeth, tilting the end mill from the vertical and locking the workhead to provide a desired "dish" or hollow grind on a rear tooth which is horizontally aligned but at a right angle to the rotating wheel, reciprocating the tooth against the wheel to provide a preselected primary clearance, sequentially indexing the remaining teeth in a horizontally aligned position so as to provide the same primary clearance, elevating the worktable upon which the fixture is mounted to give a predetermined depth of gash, playing the end mill into the wheel until it cuts to the vertical center line of the end mill while intermittently gradually elevating the worktable, longitudinally moving the worktable, indexing the end mill for cutting each gash between teeth, again reciprocatingly feeding each rear tooth into the wheel to obtain a preselected secondary clearance, and indexing the end mill and grinding each of the remaining teeth for the desired secondary clearance.

It is a specific object of this invention to provide a grinding fixture for sharpening end mills without changing a grinding wheel, which fixture may be mounted on the manually adjustable worktable of any conventional tool grinder; which fixture is easily adaptable for use with end mills of arbitrary size; which fixture, mounted for reciprocating the bottom of an end mill held therein against a thin-edged or beveled plain grinding wheel rotatable about a fixed horizontal axis, in combination with adjustments of the worktable, permits an end mill to be ground in a fraction of the time required by conventional manual grinding methods; and, most importantly, which fixture permits sharpening of the cutting edges of end mills with substantially the precision of sophisticated automatic grinding apparatus.

These and other objects of the invention, together with some of the advantages thereof, will be apparent to those skilled in the art from the following detailed description of the best mode of carrying out the invention, and the manner of making and using the same, as evidenced by the embodiments thereof illustrated in the accompanying drawings.

DETAILED DESCRIPTION OF PREFERRED EMBODIMENT OF THE INVENTION

Figure 1:
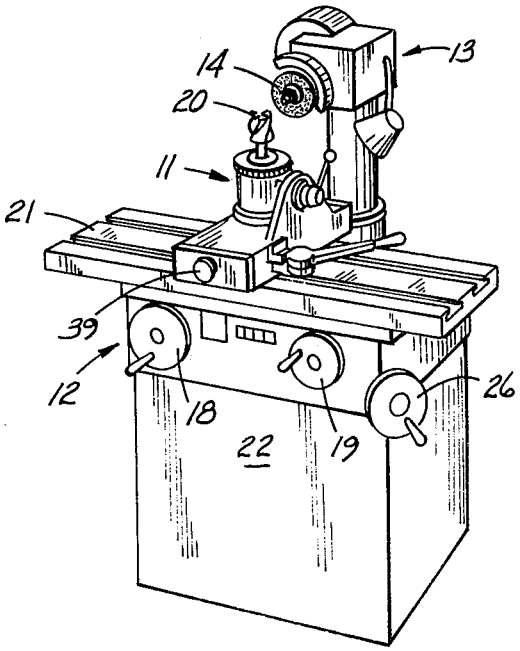
FIG. 1 is a perspective view of a conventional tool cutter and grinder with a grinding fixture in accordance with this invention mounted on the worktable of the grinder.
Figure 6:
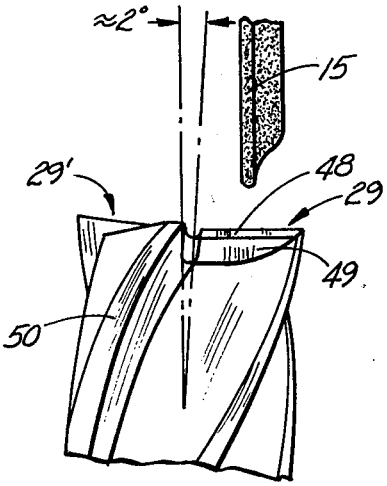
FIG. 6 is an elevational side (right) detail view of the end mill shown in FIG. 5, indicating a tilt of the end mill away from the operator to "dish" the primary surface on each cutting tooth, sequentially.
Figure 7:
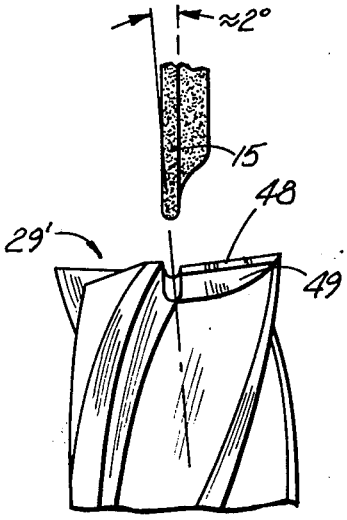
FIG. 7 is an elevational side (right) view of the end mill ready to be gashed, indicating a tilt of the end mill toward the operator, with the right side tooth parallel to the front surface of the wheel.

As has already been stated hereinabove, the focus of my invention is a combination of a uniquely constructed tool-grinding fixture, referred to generally in FIG. 1 by reference numeral 11, and an associate conventional tool grinder (also referred to as a universal cutter and tool grinder) indicated generally by reference numeral 12. A suitable tool grinder is typified by a universal tool and cutter grinder such as Model K 500 made by Kuhlmann America Inc. with a vertical wheel head adjustment, or U.S. Millrite Model KMVN made by U.S. Burke Machine Tool Co., having a fixed grinding head referred to generally by reference numeral 13. Of course a vertically adjustable head such as that provided on a Cincinnati No. 2 grinder, or a conventional magnetic surface grinder may also be used, but I refer herein to a fixed head grinder to draw attention to the fact that the grinder is preferably provided with a grinding wheel 14 mounted for rotation about a fixed horizontal axis (y-axis), so that its surface rotates in a vertical plane, and once the wheel is positioned its axis of rotation is not moved. The grinding wheel 14 is a plain wheel, dish wheel, saucer wheel, or a flat laminar disc-type wheel which is relatively thin, that is, having an overall thickness in the range from about 0.125 in. to about 0.25 in. These wheels are hereinafter referred to collectively as a "plain wheel," characterized by their beveled rear surfaces, not visible to an operator standing directly in front of the wheel, and a relatively thin, gash-width co-related, periphery. The wider plain wheel is used for very large end mills in excess of 2 ins. in diameter. Smaller end mills are preferably sharpened with a thin wheel having a periphery about 0.125 in. in thickness or less. Whatever the thickness of the wheel 14 it is essential to provide a circumferential grinding periphery 15, as shown in FIG. 7, a detail view on an enlarged scale, which periphery corresponds in thickness to the width of a gash 27 to be cut in an end mill 20, which is to be sharpened. Where the thickness of the wheel 14 is greater than the width of the gash, the wheel is beveled at its periphery to present an acute angle from the front surface 16 to the rear surface 17 (as seen in the detailed enlarged view shown in FIG. 6). As stated hereinabove, a saucer wheel, dish wheel, or the like, may be used if it meets the foregoing criterion for its periphery.

The grinder 12 includes a worktable 21 translatably mounted on a base 22, so that the worktable may, by turning a first hand wheel 18, be moved to and fro along a longitudinal (left to right) axis (or x-axis); by turning a second hand wheel 19 the worktable may be cross-fed, that is moved toward and away from the operator along a horizontal axis (or y-axis); and, by turning a third hand wheel 26, the worktable may be adjusted vertically along a vertical axis (or z-axis), to control the vertical height between the bottom of the grinding wheel 14 and the upper or top surface of the worktable 21. The vertical adjustment may be for the wheel on the grinding head, rather than on the worktable, as stated hereinbefore.

Figure 4:
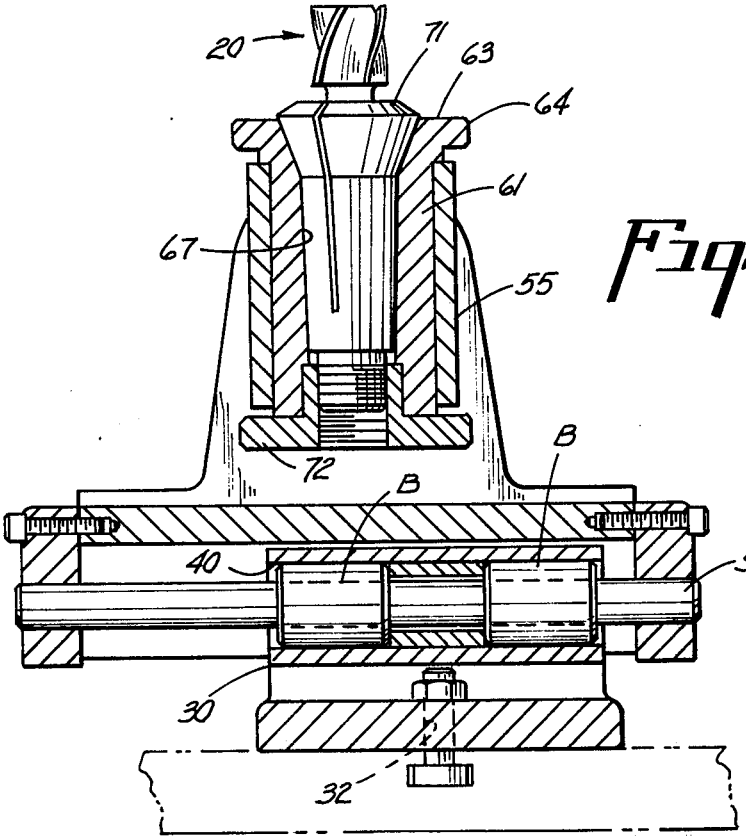
FIG. 4 is a side elevational view in staggered cross-section along the line 3—3 in FIG. 2 showing the mounting of the linearly reciprocable carriage.
Figure 3:
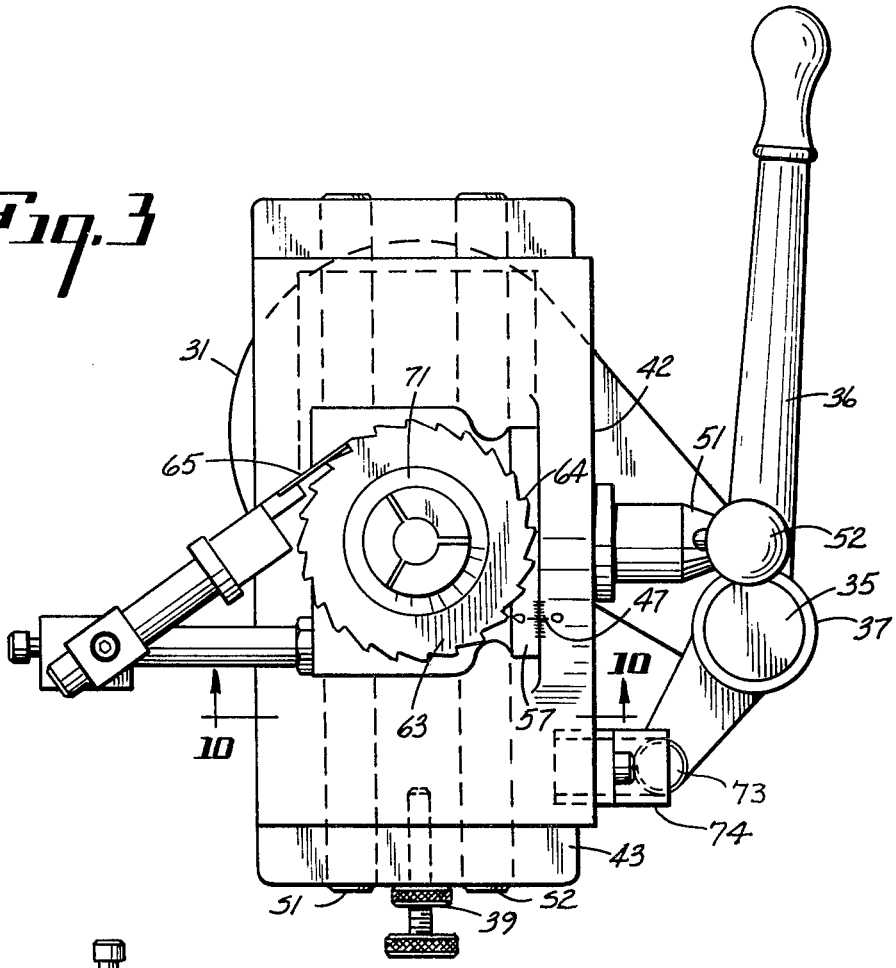
FIG. 3 is a top plan view of the grinding fixture shown in FIG. 2.
Figure 2:
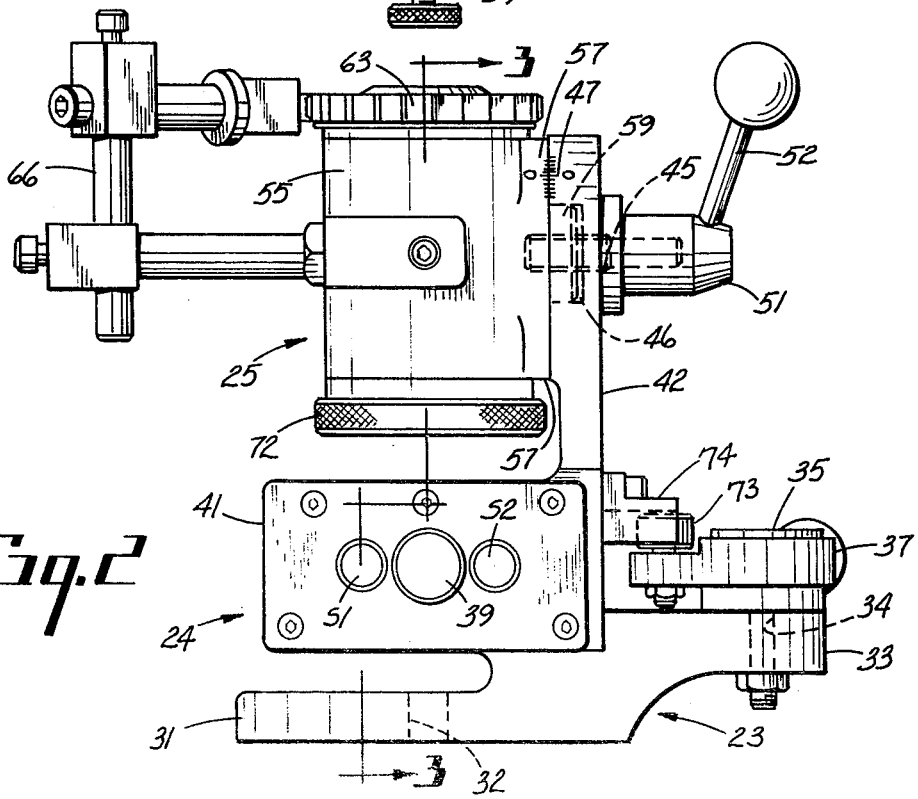
FIG. 2 is a front elevational view of the grinding fixture shown in FIG. 1, showing the assembled relationship of the components.

Removably mounted on worktable 21 is the tool grinding fixture 11 of my invention which is shown in more detail in FIGS. 2, 3 and 4. The fixture 11 includes a base member, referred to generally by reference numeral 23, on which is reciprocably disposed a carriage means, indicated generally by reference numeral 24. The carriage 24, in turn, carries tiltably disposed thereon, a workhead referred to generally by reference numeral 25.

The base member 23, includes a circular base plate 31, a bearing block 30 (seen more clearly in FIG. 4) above the base plate and a projecting pivot platform 33. The base plate 31 is provided with a vertical bore 32 for passage of a mounting bolt (not shown) which in cooperation with a nut lodged in a slot of the worktable, secures the base member 23 to the worktable. It is preferred to form the base member 23 as a unit, for example by casting it from a ferrous metal, preferably steel, to allow the base plate 31 to be magnetically secured to the worktable 21, if provision for a magnetic worktable is made. Magnetic worktables are commonly provided on surface grinders which can thus be used with the grinding fixture of this invention to sharpen a variety of end mills.

The projecting pivot platform 33 is provided with a vertical bore 34 for a pivot bolt 35. The pivot bolt 35 secures a bearing 37 to pivot platform 33. The bearing 37 is press-fitted into a handle 36. The handle 36 serves to reciprocate the carriage 24 linearly as will be explained more fully hereinafter. In operation, pulling on the handle by an operator standing in front of the grinder 12 feeds the carriage away from the operator, pushing on the handle brings the carriage toward the operator.

Figure 10:
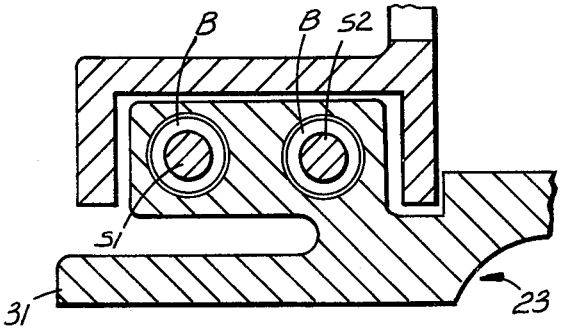
FIG. 10 is a front elevational cross-section, with portions broken away, showing a detail of the carriage mounted for linear reciprocation with twin shafts slidably disposed in precision ball bushings fitted in a bearing block.

The bearing block 30 is provided with parallel spaced apart bores 40 and 40' (not visible in FIG. 4) in which bearing means B are fitted. Preferred bearing means are ball bushings such as the Series XA Ball Bushings of Thomson Industries, Inc. and two ball bushings are used in each bore, one at each end. The ball bushings are retained in the bores with conventional retaining seals and a spacer (not shown) is provided in the bearing block to prevent relative inward movement of the ball bushings. A detail view of the mounting of the carriage is shown in FIG. 10.

The carriage 24 serves to translate the workhead 25 which it carries, along the horizontal axis (y-axis) toward and away from the grinding wheel 14. The particular structure of the carriage is not critical provided it is accurately translatable linearly, to and fro, along the y-axis. In a preferred embodiment, the carriage 24 comprises a frame 41 having a workhead support 42. The frame 41 and workhead support 42 are preferably formed as a single unit, as by casting.

The frame 41 is provided with end walls 43 and 43' in which end walls a pair of shafts $S_1$ and $S_2$ are tightly fitted horizontally in parallel, laterally spaced apart relationship. It is preferred for minimizing vibrations effects, that the shafts be slightly offset with respect to one another (not apparent in the drawings) so that both are not in the same plane (defined by the x and y axes). The shafts $S_1$ and $S_2$ are inserted through the ball bushings 13 in the bearing block 30, and are slidably precisely supported in the ball bushings. Thus the carriage 24 is reciprocable inwardly towards and under the grinding wheel 14 until the end wall 43 contacts the bearing block 30; and, outwardly until the end wall 44 contacts the bearing block. An adjustable stop means 39 is provided in end wall 43 for fine adjustment of the limit of travel, to avoid having to make the adjustment with the cross feed of the worktable.

The workhead support 42 is provided with a stepped longitudinal passage including a longitudinal bore 45 and an annular counterbore 46. As is illustrated, the workhead support 42 is rounded at the top and a reference mark 47 is inscribed thereon, corresponding to the vertical position of an end mill held in the workhead which is rotatably supported in the stepped passage.

It will be evident that an obvious modification of the foregoing embodiment of a carriage means is to provide a base member with a vertical support and to employ a carriage translatably disposed on the vertical support, with suitable bearing means.

Referring further to FIG. 2 it is seen that workhead 25 is mounted on the workhead support 42, so that the workhead is in a generally vertical position. A draw-in bolt 51 secures the workhead in any desired position whether vertical or angularly disposed to the vertical axis. For convenience, the draw-in bolt 51 is provided with a handle 52.

The workhead 25 comprises a generally cylindrical barrel member 55 with a stepped cylindrical protrusion extending laterally from the barrel at a right angle with respect thereto. The stepped protrusion includes an outer machined circular shoulder 57 the peripheral surface of which is graduated in degrees around its entire circumference, and an axial boss 59 provided with a threaded axial bore 59 in which draw-in bolt 51 is threadedly engaged to secure the barrel 55 in any preselected attitude which can be read on the graduated scale, in relation to reference mark 47. The barrel 55 is thus rotatably mounted for rotation about the x-axis, which axis of rotation is at a right angle to the longitudinal axis (vertical z-axis) of the barrel. The axial boss 59 snugly fits in the annular counterbore 46.

A sleeve member 61 is rotatably disposed in close-fitting engagement within an axial bore 62 in the barrel 55. The sleeve member 61 is provided at one end with an integral circular index plate 63 which projects radially outwards and rests on barrel 55. The periphery of the index plate is toothed or serrated with a plurality of serrations 64; the number of serrations provided is correlatable to the number of teeth to be sharpened in an end mill, and is a multiple thereof. For example, an index plate with 24 serrations may be used to sharpen end mills with 2, 3, 4, 6, 8 and 12 teeth. An end mill with 5 teeth will require an index plate with a number of serrations which is a multiple of 5.

The index plate 63 cooperates with a spring-biased finger 65 is arresting the index plate in any desired position by lodging between adjacent teeth. The finger 65 is supported on a finger support 66 which is conventiently mounted on barrel 55.

The sleeve member 61 is provided with an axial bore 67 which slidably snugly accomodates a straight pull-in collet or shaft, and tapered collers and shafts, in a conventional manner. Where, for example, a tapered collet 71 is to be used to mount the end mill 20 to be sharpened, the small end of the collet is threaded to engage threaded draw-in collar 72. When draw-in collar 72 is tightly screwed upon the threaded end of the collet 71, it securely holds the end mill therein, and the end mill may be rotated about an axis in the vertical plane using the index plage 63, without permitting any other movement.

As has been stated hereinbefore, it is critical that the carriage 24, and therefore the end mill to be sharpened, be linearly reciprocable at least over the radial length of a tooth to be sharpened. This reciprocable motion is effected manually by moving handle 36 back and forth, pivoting the handle about pivot bolt 35 so that cam follower 73 in cam 74 on the frame 41 causes the carriage to reciprocate as desired, while the grinding wheel contacts the tooth to the sharpened.

A better understanding of the relationship of the elements of my grinding fixture and its unique capability to permit the manual sharpening of the cutting teeth of an end mill, without removing the end mill from the fixture, and utilizing a stationary, beveled plain grinding wheel, will be had from the following detailed instructions for sharpening a standard four-fluted end mill (right hand cutting teeth), with the aid of the accompanying illustrations. It is to be borne in mind that if there is no vertical adjustment of the worktable, then the grinding wheel must be vertically adjustable.

It will be apparent that the apparatus of this invention permits only an angular primary and secondary relief grind for the bottom cutting edges of an end mill, and cannot provide an arcuate relief grind as is provided, for example, in U.S. Pat. No. 3,816,955. In other words, each primary face 48 and each angularly related secondary face 49 of each tooth is planar rather than curved, since reciprocation of the carriage is linear and not arcuate. It will also be apparent that the grinding fixture of this invention will not sharpen the flutes 50 of an end mill.

Figure 5:
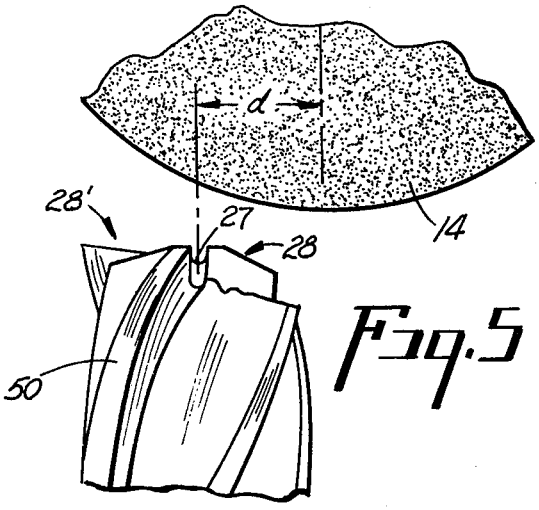
FIG. 5 is an elevational front detail view of a portion of a four-fluted end mill with its vertical center line in laterally spaced-apart relationship relative to the vertical center line of the wheel, to provide primary reliefs.
Figure 8:
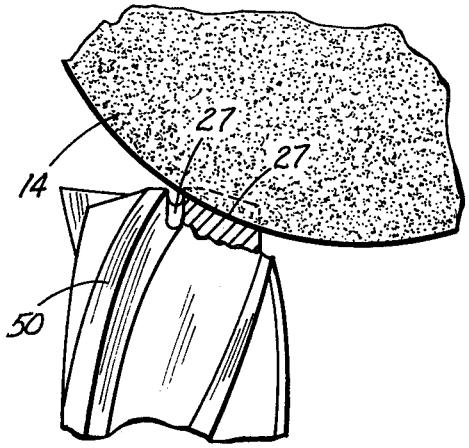
FIG. 8 is a front elevational detail view of the end mill shown in FIG. 7 being gashed, the periphery of the wheel cutting to the vertical center line of the end mill, or slightly past it.
Figure 9:
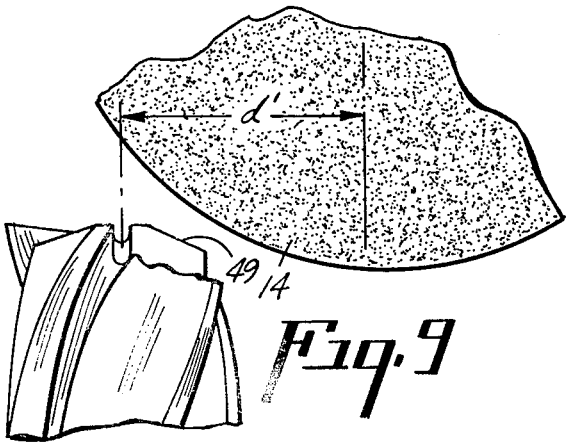
FIG. 9 is a front elevational detail view, with parts of the wheel and a portion of the right side tooth of the end mill broken away, for grinding the secondary relief, showing the relatively larger relative lateral displacement of vertical center lines of end mill and wheel, in comparison with the displacement used to provide primary relief. The rearward tilt of the end mill, generally the same as that for the primary relief as shown in FIG. 6, is not discernible in this front view.

In the enlarged illustrations, FIG. 5 illustrates an end mill 20 locked in the workhead to have the primary surfaces 48 cut on the teeth. To sharpen tooth 29, teeth 28 and 28' are longitudinally aligned and the end mill is tilted through the plane of the paper (away from the operator) as seen in FIG. 6. The end mill is then gashed, generally with a slight rake about 2° (tilt toward the operator) as shown in FIG. 7, and stopped so it is gashed to the center as shown in FIG. 8. Secondary surfaces 49 are then cut, and are angularly related to the primary surfaces 48 as shown in FIG. 9. It will be evident that the sequence of the operations is not critical, but best results are obtained as described below.

SHARPENING AND OPERATION

Mount a "plain" grinding wheel, about 0.25 in. thick, on the arbor of a conventional universal cutter and tool grinder, and dress the periphery of the wheel so it is beveled to about 30° from the vertical, the angle being towards the rear of the wheel so that the bevel is not visible from directly in front of the wheel. The periphery of the wheel used is necessarily dressed to the thickness of the gash desired in the end mill to be sharpened. Alternatively a saucer wheel with a thin periphery may be used, though it will be recognized that it too will require that its periphery be dressed as it wears, particularly for relatively small diameter end mills less than about 1 in. in diameter.

Mount the 4-fluted end mill 20, to be sharpened, in the jaws of the collet 71 held vertically in the workhead 25, and tighten the draw-in collar 72 so that the end mill is tightly held in the collet with oppositely disposed cutting teeth aligned along the y-axis, i.e., normal to the plane of the wheel 14. This may be done visually and checked by positioning the worktable so that the longitudinal teeth 28 and 28' lie substantially parallel to the face of the wheel, without actually contacting the wheel. In this position, the longitudinal axis (vertical) of the end mill is longitudinally (along the x-axis) displaced relative to the vertical center line of the wheel 14, and to the left thereof, as illustrated in FIG. 5, a distance d, according to known computations, to establish the degrees of primary relief angle or primary clearance desired. Some illustrative values, for setting the relative displacement are set forth in Table I hereinbelow for some commonly used diameters of grinding wheels. For right hand end mills, the end mill is displaced left of the vertical center line of the wheel; as will be evident, for a left hand end mill, all the grinding operations are carried out on the right of the vertical center line of the wheel.

TABLE I

| Diam of grinding wheel (ins.) | Lateral relative displacement 'd' (ins.) of Vertical center lines of end mill and wheel, for relief angle to cut primary surface or face | | | | |
|---|---|---|---|---|---|
| | 3° | 4° | 5° | 6° | 7° |
| 3 | .078 | .105 | .131 | .157 | .183 |
| 4 | .105 | .140 | .176 | .210 | .244 |
| 5 | .131 | .175 | .220 | .262 | .306 |
| 6 | .157 | .210 | .262 | .316 | .366 |
| 6 | .185 | .246 | .308 | .370 | .430 |
| 8 | .211 | .282 | .352 | .422 | .492 |

The relative displacement 'd' may be approximated visually, but for precision, should be set by reading it on the graduated scale commonly provided on the hand wheel 18 which effects longitudinal (x-axis) movement of the worktable 21.

The end mill is now brought forward along the horizontal axis, away from the wheel, sufficiently to permit the end mill to be tilted towards the wheel and away from the operator to provide the desired "dish" for the teeth. Though on occasion, no dish, (that is, zero angle) is specified, typically an end mill is provided with from about 2° to about 3°. The desired manufacturer's suggested angle (say 2°) is set by aligning and locking the 2° scale graduation on the circular shoulder 57 with the reference mark 47 on the workhead support 42.

The end mill is now cross-fed toward the wheel so that the periphery of rotating wheel 14 lies essentially along the transverse of the end mill and the cutting edge of the right hand tooth 28 lies parallel to the face of the wheel, while just avoiding contact therewith. The adjustable stop means 39 on the carriage 24 is now set so that the end mill may be fed to the same location by a pulling movement of the handle 36. The end mill is now brought forward towards the operator so that the rear (first) tooth 29 clears the wheel and the worktable is gradually raised until the farthest portion of the rear tooth just contacts the rotating wheel. The end mill is now played into the wheel, pulling on the handle 36, and the rear tooth is ground to the center of the end mill, the end mill being stopped at the preselected location by the adjustable stop means 39. Grinding of the tooth can be observed all the while because the tooth is being sharpened directly in front of, and in full view of the operator. The end mill is then retracted (brought forward towards the operator) so it clears the wheel, by pushing on the handle 36. If sufficient stock has not been abraded, the end mill is raised a fraction of an inch, by the handwheel 26 for vertical adjustment of the worktable, and the rear tooth is again played (cross-fed) into the wheel pulling on the handle. The rear tooth is thus sharpened with the desired primary clearance.

The end mill is now retracted to clear the wheel by pushing on the handle 36, the index plate 63 is rotated, the finger 65 clicking off 6 of the 24 serrations on the index plate to set the next (second) tooth 28' at a right angle to the plane of the wheel. The adjustable stop means having been set for the first tooth, it is not to be reset. The second tooth is now played on to the wheel, and since the vertical and horizontal relationship between the second tooth of the end mill and the wheel is the same as that of the first tooth, it is sharpened in exactly the same manner. Again the end mill is retracted, indexed to the third tooth 29' and sharpened; and the fourth tooth 28 is similarly sharpened.

Having sequentially sharpened each tooth for primary clearance, the end mill is now ready to be gashed. The end mill is retracted to clear the wheel and the workhead is unlocked so that the end mill can be tilted forward to rake the gash 27 according to manufacturer's standards. Typically 2° is desirable, so the graduated scale on the circular shoulder 58 of the workhead is aligned for 2° against the reference mark 47, and locked. Thus the end mill is tilted as shown in the detail side elevational view in FIG. 7, in the opposite direction from vertical, compared with its tilt for grinding the dished primary clearance. Now to position the end mill properly, it is cross-fed with hand wheel 19 towards the wheel, and to the left side thereof, so that the front surface of the periphery of the wheel is adjacent the right hand tooth which lies parallel to the front surface of the wheel. The adjustable stop means is set so that the end mill can be advanced no further into the wheel. The end mill is now moved longitudinally to the left of the wheel's vertical center line, and the worktable is raised about an eighth of an inch (one or two turns of the hand wheel 26 for vertical adjustment). Now feed the end mill horizontally into the wheel; moving the worktable to the right by using the handwheel 18 for longitudinal adjustment, so that the wheel cuts a gash to the vertical center line of the end mill without leaving a small teat at the center. Now set the longitudinal stop on the worktable for this location to limit its longitudinal travel so that the wheel does not cut much farther than the center of the end mill, whereby all gashes will be cut to the same central position. A detailed front view, on an enlarged scale, of the end mill being gashed is illustrated schematically in FIG. 8. The right hand tooth, the cutting edge of which lies adjacent and parallel to the face of the wheel, but not touching it, is broken away, for clarity. Having cut the gash, the end mill is moved to the left, longitudinally away from the wheel by the handwheel for the worktable, and the end mill is indexed with the index plate, for the next gash, and sequentially, each succeeding gash; and, each is gashed in the same manner as the first gash.

After gashing the mill, it may be desirable to repeat the operations for cutting the primary clearance just to put a finish cut on the teeth after gashing, but this repetition is not generally necessary. Having now gashed the end mill, the final operation is to grind the secondary clearances.

The end mill is moved away from the wheel, the workhead loosened and the original tilt of 2° for the primary clearance is reset on the workhead. Move the end mill to the left of the wheel, as illustrated in FIG. 9, showing a detailed enlarged view, with the right side tooth broken away to show the horizontally aligned rear tooth in elevational profile. The tilt of the end mill, to provide the correct dish for the secondary clearance, which tilt is the same for the primary relief (as shown in FIG. 6) is not visible in FIG. 9. Now gradually play the end mill towards the wheel while reciprocating the carriage so that the essentially linear segment of the periphery of the wheel corresponding to the secondary clearance, as illustrated by the dashed lines, is moved to and fro over the entire horizontal portion of the cutting tooth. The longitudinal limit of travel d' of the worktable towards the vertical center line of the wheel, is set when the desired secondary clearance is ground on the first tooth. As shown in FIG. 9 it will be apparent that the distance d' is measured with the end mill in contact with the wheel, in a position which gives the desired secondary clearance. The end mill is shown laterally displaced in FIG. 9, for the sake of clarity. The operation is repeated on each of the remaining teeth, simply by moving the end mill away from the wheel, indexing it to the desired tooth and playing the tooth on the wheel, so that all the secondaries are evenly ground.

The bottom cutting edges of the end mill are now fully sharpened without having removed the end mill from the collet. Though the apparatus of the invention has been particularly described with respect to the sharpening of the bottom cutting edges of an end mill, it will be evident that any cutting tool in which angularly related primary and secondary surfaces are to be provided on the teeth, for example a shell mill, may be sharpened on this apparatus.

I claim:

1. Apparatus for sharpening the cutting teeth of an end mill and cutting a gash between successive teeth comprising a grinding fixture in which said end mill is removably mounted, and, a grinder having a longitudinally and horizontally adjustable worktable on which said grinding fixture is demountably disposed, and, a plain grinding wheel mounted for rotation about a horizontal axis above said worktable and vertically adjustable relative thereto, said wheel having a periphery the thickness of which is no greater than the width of said gash, said grinding fixture comprising: (a) a base member; (b) a carriage reciprocably mounted on said base member; (c) means to reciprocate said carriage linearly along the horizontal axis toward and away from said wheel; and (d) a generally vertically disposed workhead rotatably mounted on said carriage for rotation about a longitudinal axis only, said workhead in which said end mill is axially held including (i) a barrel member, (ii) a sleeve member and cooperating index plate means, said sleeve member being rotatably disposed within said barrel member, said index plate having spaced peripheral serrations the number of which is a multiple of the number of said teeth to be sharpened, and (iii) detent means operable to hold said index plate in a position to sharpen said each tooth and gash said end mill so that said teeth are sharpened and said end mill is gashed without removing said end mill from said workhead or changing said wheel.

2. The apparatus of claim 1 wherein said plain grinding wheel is chosen from a laminar disc-shaped wheel, a saucer wheel or dished wheel; said means to reciprocate said carriage is a manual means carried by said base member; said base member includes a bearing block and bearing means disposed therein; and, said carriage includes shaft means reciprocably disposed within said bearing means.

3. A grinding fixture for sharpening the cutting teeth of an end mill held therein and cutting a gash between successive teeth without removing said end mill from said fixture which comprises, (a) a base member having bearing means, including ball bushings in which a pair of generally horizontal shafts are slideably supported, (b) a carriage reciprocably mounted on said base member, (c) means to linearly reciprocate said carriage along a horizontal axis, including a cam, cam follower and handle means for manually effecting reciprocation of said carriage, (d) means to limit the travel of said carriage to a preselected position, for each tooth to be sharpened on an end mill axially held in (e) a generally vertically disposed workhead rotatably mounted on said carriage for rotation about only its longitudinal axis which is at a right angle to said horizontal axis, said worhead including:

(i) a barrel member, (ii) a sleeve member and cooperating index plate means, said sleeve member being rotatably disposed within said barrel member, said index plate having spaced peripheral serrations the number of which is a multiple of the number of teeth to be sharpened so as to permit sequential alignment of each tooth horizontally, immediately before it is sharpened, and, (iii) detent means operable to hold said index plate in a position to sharpen said each tooth and gash said end mill, so that said teeth are sharpened and said end mill is gashed without removing said end mill from said workhead.

* * * * *